US005423265A

United States Patent [19]

Wang

[11] Patent Number: 5,423,265

[45] Date of Patent: Jun. 13, 1995

[54] RIBBON CARTRIDGE

[76] Inventor: Kun-Meng Wang, Suite 1, 11F, No. 95-8, Chang Ping Road, Sec. 1, Taichung, Taiwan, Prov. of China

[21] Appl. No.: 89,851

[22] Filed: Sep. 2, 1993

[51] Int. Cl.[6] ..... F42B 4/04

[52] U.S. Cl. ..... 102/361

[58] Field of Search ..... 102/361

[56] References Cited

U.S. PATENT DOCUMENTS

| | | | |
|---|---|---|---|
| 743,302 | 11/1903 | Littlepage | 102/356 X |
| 1,305,188 | 5/1919 | Bergmann | 102/339 |
| 1,434,784 | 11/1922 | Lucas | 102/346 X |
| 2,269,582 | 1/1942 | Decker | 102/340 |
| 2,913,983 | 11/1959 | Lytle | 102/346 X |
| 3,930,448 | 1/1976 | Barber et al. | 102/356 X |
| 4,013,009 | 3/1977 | Claude et al. | 102/35.6 |
| 4,418,624 | 12/1983 | Willi et al. | 102/351 X |
| 5,003,881 | 4/1991 | Herold et al. | 102/337 |

*Primary Examiner*—Peter A. Nelson

[57] ABSTRACT

A ribbon cartridge comprises generally a tubular casing, a base seat submerged in the bottom portion and a plurality of rolled stripped color ribbons and color patterns thereof filled in the casing. A detonator cup filled with a predetermined amount of gun powder is in the core of the base seat. The disclosure is characterized in providing combined effects of explosion and dispersing out of the color ribbons and color pattern when it is triggered in a toy gun, for creating greater intersting and joyous air.

1 Claim, 2 Drawing Sheets

A – A

RIBBON CARTRIDGE

BACKGROUND OF THE INVENTION

The present invention relates to cartridge or bullet, more particularly to a ribbon cartridge which is filled with color ribbons and adapted to load in a toy gun, firing to create interesting and joyous air.

It is known that there are many kind of bullets or cartridges for a toy gun commercially available in the market. Most of them belong to the non-explosive pellets, e.g., a B B pellet which is made from rigid plastic material and shot whole-bodiedly by a pumping device from a toy gun. Some bullets for a toy gun are filled with a little bit of gunpower and triggered to make sound of explosion. However, they are harmless because of their low velocity.

For creating climax of amusement in a cheerful occasion such as a wedding ceremony, people use to in present time apply a confetti having a firing cord for pulling to explodedly disperse color ribbons or patterns to the heads of the bride and bridegroom, in corporating with the crackers. In general, the confetti or the non-explosive pellet is not satisfactory in use because of the following disadvantages:

a) they can not provide dual functions of an explosion and a dispersing color ribbons concurrently, and
b) a confetti is relatively expensive than a ribbon cartridge of the present invention which can provide combined effect.

SUMMARY OF THE PRESENT INVENTION

The main object of the present invention is to provide a ribbon cartridge which can be fired in a toy gun to concurrently disperse color ribbons incorporating with explosion to create climaxing air of amusement.

Accordingly, the present invention of a ribbon cartridge comprises generally a tubular casing integrally formed with a circular base seat on bottom portion and filled with color ribbons therein. The tubular casing has an annular flange extended laterally from it's lower rim in predetermined width and thickness. The base seat which is positionally submerged in the bottom portion and integrally formed with the inner periphery of the casing comprises a less diameter circular hole concentrically formed on its central portion having a diametric rib integrally formed across the center and connected on two ends with the opposit circumferences of the hole so as to equally divide the hole ito a pair of cresent apertures thereof. A cylindrical anvil is perpendicularly connected on one end to the center of the outward surface of the diametric rib and extended outwardly along the longitudinal axis of the tubular casing. The anvil is spacedly encircled by a cylindrical wall which is connected on one end with the circumference of the circular hole and extended outwardly parallel to the anvil. They are ended at a position equal to the lower rim of the casing. So that an annular groove is thus defined in between the outer periphery of the cylindrical wall and the inner periphery of the casing. A detonater cup filled with a predetermined amount of gun powder therein is fixedly inserted on opening portion into the tubular wall of the base seat. Finally, a plurality of rolled stripped color ribbons are superposedly filled in the casing and chocked with pieces of circular or star shaped patterns.

When the ribbon cartridge is loaded in a toy gun and percussed on the detonator cup against a hammer of the gun, an explosion of the powder will make sound and provide adequate impact to forceably disperse the color ribbons out of the cartridge in a predetermined distance.

The objects and advantages will become more apparent in a consideration of enusing the discription and drawings.

DETAIL DESCIPRTION OF THE PREFERRED EMBODIMENT OF THE PRESENT INVENTION

Figure 1:
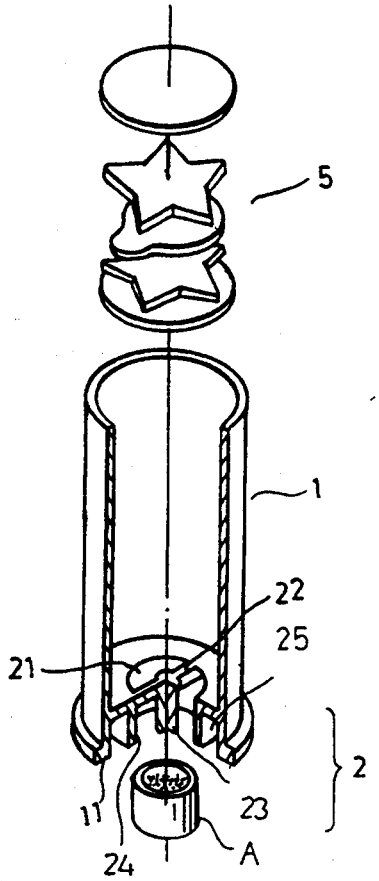
FIG. 1 is an exploded perspective view to show the preferred embodiment according to the present invention.
Figure 4:
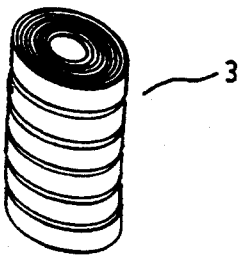
FIG. 4 is a perspective view to show a plurality of rolled stripped color ribbons supperposedly filled in the casing of the cartridge.
Figure 2:
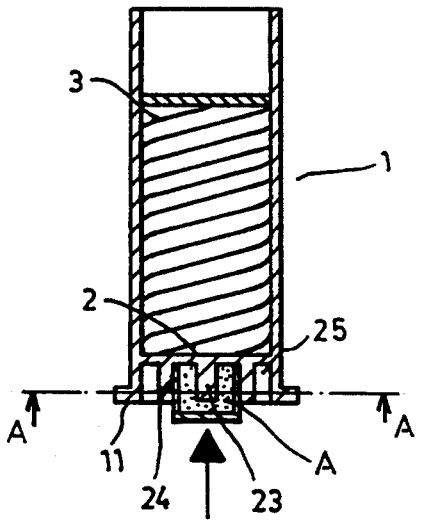
FIG. 2 is an elevational section to show the preferred embodiment according to the present invention.

Referring to FIGS. 1 and 2, the present invention of a ribbon cartridge comprises generally a tubular casing 1 integrally formed with a circular base seat 2 on bottom portion and a plurality of color ribbons 3 filled therein.

Figure 3:
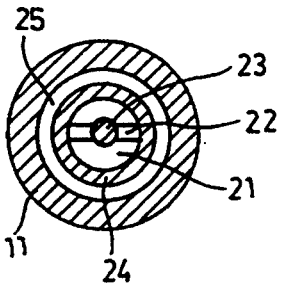
FIG. 3 is a cross-sectional view taken along line A—A of FIG. 2.

The tubular casing 1 has on annular flange 11 extended laterally from its lower rim in predetermined width and thickness. the base seat 2 which is positionally submerged in the bottom portion of the tubular casing 1 and intergrally formed with the inner periphery of the casing 1 comprises a less diameter circular hole 21 concentrically formed on its central portion having a diametric rib 22 integrally formed across the center of the circular hole 21 and connected on two ends with the opposite circumferences of the hole 21 so as to equally divide the hole 21 into a pair of crescent apertures thereof (see FIG. 3). A cylindrical anvil 23 is perpendicularly connected on one end to the center of the outward surface of the diametric rib 22 and extended outwardly along the longitudinal axis of the tubular casing 1. The cylindrical anvil 23 is spacedly encircled by a cylindrical wall 24 which is connected on one end with the circumference of the circular hole 21 and other end extended outwardly parallel to the anvil 23. They are ended at a position equal to the lower rim of the casing 1. So that an annular groove 25 is thus defined in between the outer periphery of the cylindrical wall 24 and the inner periphery of the casing 1. A detonator cup A filled with a predetermined amount of gun powder therein has an outer diameter equaled to the inner diameter of the cylindrical wall 24. So that the detonator cup A can be fixedly disposed therein on it's opening portion toward the cylindrical anvil 23. Furthermore, the cylindrical anvil 23 is normally enclosed with the gun powder therein and the tail of the detanator cup A is slightly outcropped from the bottom surface of the tubular casing 1.

Referring to FIGS. 1, 2 and 3, a plurality of rolled stripped color ribbons 3 are superposedly filled in the upper portion of the tubular casing 1 and checked with pieces of circular or star shaped color patterns 5 therein.

When the ribbon cartridge of the present invention is loaded in a toy gun and percussed on the detonator cup A against a hammer of the gun, an explosion of the powder will provide adequate impact to forceably disperse the color ribbons and color patterns out of the cartridge in a predetermined distance and to concurrently make a sound of explosion for creating joyous air.

Based on aforediscussed structure, the present invention of a ribbon cartridge is characterized in following features and advantages:

a) it provides combined effects of the explosion and the dispersing color ribbons concurrently to create greater intersting and joyous air, and b) it provides a ribbon cartridge less expensive in use and easier to manufacture, The scope of this invention should determined by the appended claims and their legal equivalents rather than by the examples given in afore-discussed specification.

I claim:

1. A ribbon cartridge comprising generally a tubular casing integrally formed with a circular base seat on bottom portion and a plurality of rolled stripped color ribbons filled therein;

said tubular casing having an annular flange integrally formed and laterally extended from lower rim in a predetermined width and thickness.

said circular base seat being formed positionally submerged in the bottom portion of said tubular casing comprising:

a less diameter circular hole, said hole being concentrically formed at the center of said base seat having a diametric rib extended across the center and connected on two end to the opposite circumference of said circular hole which is equally divided by said rib into a pair of crescent apertures;

a cylindrical anvil, said anvil being perpendicularly connected on one end to the center of the outer surface of said diameter rib and extended outwardly along the longitudinal axis of said tubular casing, then ended at a position equaled to the lower rim of said casing;

a cylindrical wall, said wall being connected on one end to the circumference of said circular hole and extended outwardly parallel to said cylindrical anvil, having said anvil been spacedly encircled therein;

an annular groove, said groove being integrally formed in between the outer periphery of said cylindrical wall and the inner periphery of said tubular casing;

a detonator cup, said detonator cup filled with a predetermined amount of gun powder and fixedly disposed on the opening portion toward said cylindrical anvil into said cylindrical wall, having said anvil enclosed with said gun powder therein and the tail of said detonator cup slightly outcropped from the bottom surface of said tubular casing;

when said ribbon cartridge having percussed on its detonator cup against a hammer in a toy gun, an explosion having occurred incorporated with an impact adequate to forceably disperse said color ribbons and said color patterns out of said gun.

* * * * *